United States Patent [19]

Sipowicz

[11] 4,041,240

[45] Aug. 9, 1977

[54] ELECTRICAL FEED-THROUGH ASSEMBLY AND METHOD OF MAKING SAME

[76] Inventor: Alexander D. Sipowicz, 4218 W. 168th St., Lawndale, Calif. 90260

[21] Appl. No.: 638,524

[22] Filed: Dec. 8, 1975

[51] Int. Cl.[2] ..... H01B 17/30

[52] U.S. Cl. ..... 174/151; 29/592; 339/218 M

[58] Field of Search ..... 174/18, 23 R, 151, 152 R; 339/94 A, 94 M, 218 R, 218 M; 29/592, 624, 631

[56] References Cited

U.S. PATENT DOCUMENTS

| | | | |
|---|---|---|---|
| 3,437,149 | 4/1969 | Cugini et al. | 174/151 UX |
| 3,781,453 | 12/1973 | Funk et al. | 174/151 X |
| 3,871,734 | 3/1975 | Murtland | 339/94 M |

*Primary Examiner*—Laramie E. Askin

*Attorney, Agent, or Firm*—Singer & Singer

[57] ABSTRACT

An electrical feed-through assembly adapted to be directly connected to a bulkhead assembly for conducting high voltage electrical energy between a low pressure and high pressure area. A hollow casing is removably connected by conventional means of packing glands to a bulkhead assembly. Conductors located within the casing are completely covered by dielectric materials that are bonded directly to each conductor. The conductors and the dielectric materials have different internal and external diameters to form increased bonding areas for withstanding high pressure differentials and high voltage differentials. A deformable dielectric bonding material bonds the conductors to the casing in the area of high pressure. A non-deformable dielectric bonding material adjacent to the deformable bonding material bonds the conductors to the remaining inside area of the casing.

13 Claims, 12 Drawing Figures

High Pressure
Rubber
Epoxy
Low Pressure
Epoxy
Low Pressure
High Pressure

ELECTRICAL FEED-THROUGH ASSEMBLY AND METHOD OF MAKING SAME

This invention relates to a method and apparatus for conducting high voltage electrical energy into a hostile high pressure fluid environment.

This invention has primary application in the oil well pumping art where it is now common practice in oil field production to utilize an electrically operated pump located in the oil well bore.

The electrical conductors located on the surface at ambient pressure are caused to pass through a wellhead assembly which physically isolates the higher pressures located within the oil well bore from the ambient pressures located on the surface.

In the art of extracting and pumping oil from an oil well bore, many varied and sophisticated techniques are utilized such as forcing hot liquid under pressure into the well bore to stimulate the flow of oil which is then pumped to the surface by means of the pump located within the well bore. Pressurizing the well bore to stimulate the flow of oil results in high pressures being placed on the conductors passing through the wellhead assembly.

The conductors are therefore under extreme pressure differentials between those existing on the surface and those existing in the well bore. The conductors are susceptible to deterioration from the action of the hot liquids and the hot oil being forced to the surface.

In order to facilitate the removal and replacement of defective items within the well bore, many techniques for passing the electrical conductors through the wellhead have been employed. For example, the most common technique is to use packing glands and nuts and potting compounds to secure the conductors in a locked sealing relationship within the hanger means associated with the wellhead.

Later techniques facilitated the holding and sealing of the conductors by means of an external casing welded to the hanger means and in which the individual conductors are sealed and potted.

Still another refinement is described in U.S. Pat. No. 3,437,149 issued to E. T. Cugini, et al., in which an external casing called a mandrel is removably attached to a hanger means and the conductors are potted and sealed within the casing.

The basic problem faced by all these prior art techniques is to pass a plurality of conducting materials from a low pressure to a high pressure hostile environment and in such a way as to maintain the dielectric strength of the conductors while at the same time prevent any pressure leaks from developing within and around the conductors.

The techniques used by the prior art devices have been moderately successful when used in relatively low voltage and low pressure differential environments. The basic problem facing the art today is the fact that in the high pressure, high voltage hostile environment, the potting compounds holding the conductors in place invariably are attacked by the hot oil and hot fluids used to facilitate the pumping of individual oil wells. In addition the high pressure differentials invariably cause minute cracks in the rigid bonding materials used, thereby eventually leading to leaks in the pressure which if not detected in time, have the effect of causing blow-outs in the well whenever a conductor or pair of conductors is broken loose from the bonding material.

The problems facing the art today have resulted in many different techniques being used to contain blow-outs that are caused whenever electrical conductors are disconnected from the casing as a result of the pressure differentials used. The Cugini patent identified above represents a design for containing a well blow-out by means of a double cavity wellhead which has the effect of containing a blow-out caused by the electrical conductors becoming dislodged.

The present invention is concerned with providing a new and improved mandrel in which the risks of a blow-out caused by any of the conductors being displaced is minimized to an extent not heretofore achievable by the prior art.

The basic concepts disclosed in the present invention are premised on the use of a flexible dielectric bonding material that is exposed to the high pressure environment which causes the deformable dielectric material to flow and deform in such a manner as to increase the sealing action between the conductors and the supporting casing. In this manner any movement of the deformable dielectric caused by the high pressure differential tends to seal, thereby making the sealing action failsafe, which is to cumulatively repair and seal any resulting openings. This self-healing feature is one of the basic reasons that the present invention is successful in reducing blow-outs. In the prior art patents as cited above in Cugini, an epoxy material bonds the conductors in the area of the high pressure environment. The epoxy is nonyielding and any developmental cracks eventually become catastrophic, resulting in the blow-out mentioned above.

The high voltage capabilities achieved by this invention are obtainable by means of unique fiberglass dielectric cylinders located on the conductors at both the high and the low pressure ends. Both the conductors and the internal diameters of the dielectric inserts have mating shoulders which effectively lock the inserts in place on the conductor. The dielectric inserts are bonded to the conductor and a polyolefin dielectric sheath is placed over the complete conductor so as to cover the dielectric inserts located at each end of the conductor. The polyolefin sheath is heat-shrunk in place, thereby effectively covering all exposed portions of the conductor with the dielectric material.

The individual conductor assemblies are bonded in place inside a solid casing by means of an epoxy at the low pressure end and by means of neoprene rubber at the high pressure end, which neoprene rubber is capable of deforming under pressure to effectively improve the sealing action under high pressure gradients.

The individual dielectric inserts located at each end of each conductor together with the polyolefin sheath bonded in place over the conductor present a tortuous path for any high voltage breakdown that may occur, thereby reducing to a minimum the potential for an electrical breakdown due to leakage or otherwise.

Further objects and advantages of the present invention will be made more apparent by referring now to the accompanying drawings wherein.

Figure 1:
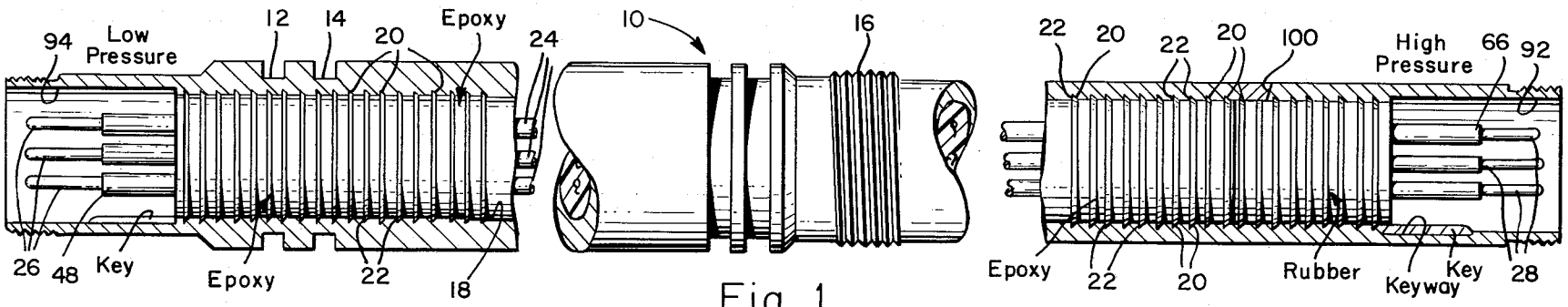
FIG. 1 is a partial cross-sectional view of a casing for passing conductors through a wellhead.

Referring now to FIG. 1, there is shown a casing of the type suitable for use in a wellhead for passing conductors from the surface to a pump located within the wellhead bore.

The casing 10 is described in connection with a wellhead since that is the inventor's best mode of operation of the invention; however, it should be understood that the described casing may be used for passing any electrical conductor through a bulkhead separating a high pressure hostile environment from a low pressure environment. The thickness of the casing 10 and the length of the casing are determined by external configurations and requirements. For example, a casing for passing electrical current through a steel shell of a nuclear reactor would have a different requirement than a casing for passing electrical current through a wellhead. In each case, however, the casing would of necessity have to be long enough and thick enough to withstand the differential pressures involved and to be able to be secured to the bulkhead separating the differential pressures.

In the preferred embodiment the casing 10 is adapted to be movably attached to a hanger means of the type illustrated in the previously cited Cugini patent. The external diameter of the casing contains grooves 12 and 14 for accepting O-rings and sealing rings not illustrated. To facilitate removal and insertion of the casing 10, suitable threads 16 are located on the outside circumference to thereby allow the casing to be movably inserted into the hanger means associated with the wellhead. The hanger means and the wellhead are not part of the present invention and hence are not illustrated.

The casing 10 is illustrated with the low pressure end located on the left and the high pressure end located on the right as illustrated.

The internal diameter 18 of the casing 10 contains a plurality of individual grooves 20. Each groove 20 is undercut into the internal diameter 18 in such a fashion as to form a right angled cross-section with the vertical side 22 opened to the high pressure end. The grooves 20 are provided to allow the dielectric bonding material holding the conductors within the casing 10 to grip the internal diameter and provide a maximum force to the pressures exerted which will be from the high pressure end to the low pressure end. The vertical side 22 will therefore provide a maximum amount of holding force for the dielectric bonding material to resist the movement caused by the high pressure differential in attempting to blow out the conductors from the internal diameter of the casing. The right triangulated cross-section of each groove 20 provides a maximum bearing strength while at the same time reducing the sheer concentration forces to a minimum.

Figure 2:
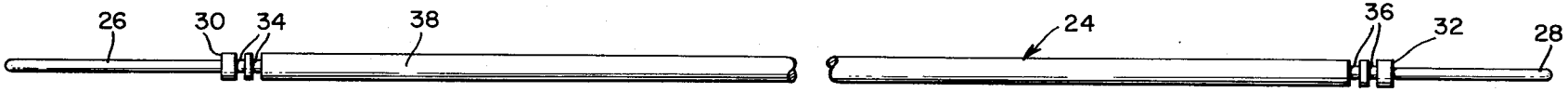
FIG. 2 illustrates a bare single conductor.

FIG. 2 illustrates one of the individual conductors 24 located within the casing 10 illustrated in FIG. 1. The actual number of conductors 24 is a function of the external requirements of the system such as the kind of pump motor located within the well bore. For example, a three-wire grounded system would require four leads whereas a three phase system ungrounded would only require three leads. In any event, each current carrying conductor 24 illustrated in FIG. 2 will have the same external configurations.

The length of the conductor 24 will of course be determined by the length of casing 10, which factors are determined by considerations external to that of the present invention.

The conductor 24 is illustrated with the low pressure end 26 on the left and the high pressure end 28 on the right. Both the diameters at 26 and at 28 are reduced to form a shoulder at 30 facing the low pressure end and a shoulder at 32 facing the high pressure end. A pair of grooves 34 are located away from shoulder 30 and in a similar fashion a pair of grooves 36 are located away from shoulder 32 from the high pressure end. The connecting diameter 38 of the conductor 24 is constant and provides a unitary structure forming the completed conductor. All conductors located within the internal diameter of the casing 10 will be the same as illustrated herein.

The improved dielectric strength and pressure handling capability of the defined feed-through assembly is achieved by properly preparing both the low pressure end 26 and the high pressure end 28 of each conductor 24.

Figure 3:
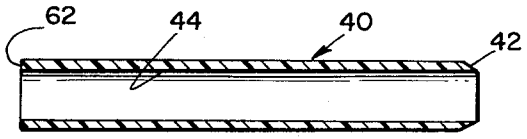
FIG. 3 illustrates a first dielectric insert for insertion over the low pressure end of the conductor in FIG. 2.

Referring now to FIG. 3, there is illustrated a dielectric insert 40 having a tapered end 42 that is adapted to slide over the low pressure end 26 of conductor 24. The internal diameter 44 of insert 40 is large enough to pass over the diameter 38 as is more fully illustrated in FIG. 6.

Figure 4:
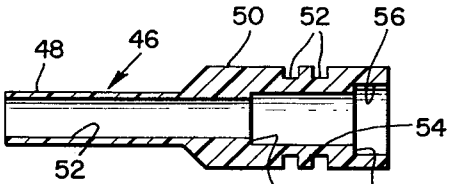
FIG. 4 illustrates a second dielectric insert for the low pressure end of the conductor as illustrated in FIG. 2.

Referring now to FIG. 4, there is illustrated a second dielectric insert 46 preferably constructed of fiberglass and having a variable external diameter varying from a minimum diameter at 48 to a maximum diameter at 50. The large diameter portion 50 contains a pair of grooves 52 which are used to increase the bonding area between the insert 46 and the bonding material.

The internal diameters of the insert 46 vary from a first diameter 52 to a larger diameter 54 which in turn communicates with a third larger diameter 56.

The junction between diameter 54 and 52 defines a first shoulder 58 whereas the junction between diameter 56 and 54 defines a second shoulder 60.

Figure 6:
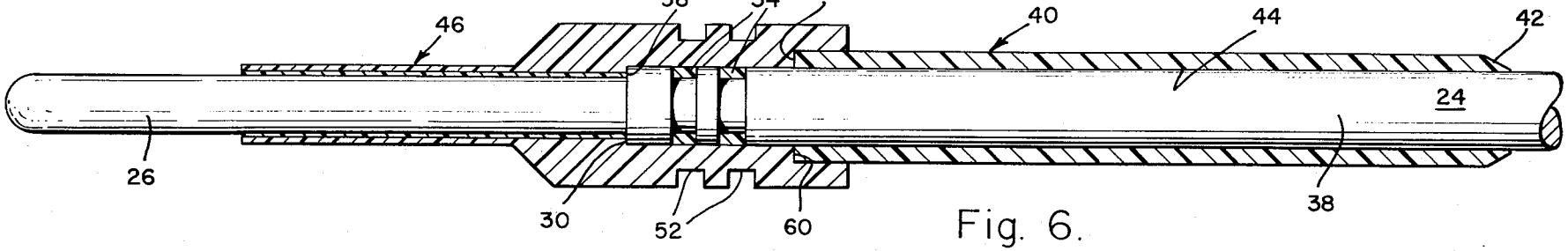
FIG. 6 illustrates the low pressure end of the conductor with the insert of FIG. 3 and FIG. 4 located in place.

The insert 46 is placed over the low pressure end of the conductor 26 until shoulder 58 abuts against shoulder 30 located on the conductor 24, as illustrated in FIG. 6. In this position the first insert 40 is then pushed to the left until the square end 62 located on the insert 40 abuts against shoulder 60 located within the second insert. This position is illustrated in connection with FIG. 6.

FIG. 6 now illustrates the low pressure end of the conductor 24 with the first insert 40 and the second insert 46 located in place. It will be apparent to those skilled in the art that the internal diameter 52 of the second insert 46 will approximate the diameter of the conductor as identified at the low pressure end 26. In addition, the internal diameter 54 of the insert 48 will approximate the outside diameter of the shoulder portion 30 located on the conductor 24. Similarly, the internal diameter 56 of the insert 48 will approximate the outside diameter of the first insert 40.

In the preferred process the insert 46 and the insert 40 are bonded to the conductor 24 in their preferred locations as identified in FIG. 6 by means of epoxy. The process of setting the epoxy includes heating the inserts and the conductors to a temperature of 160° F for three to four hours. During this time the insert 46 and 40 will be permanently bonded to the low pressure end of the conductor 24.

Figure 5:
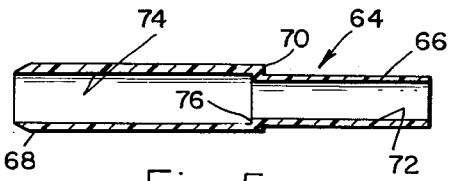
FIG. 5 illustrates a dielectric insert for insertion over the high pressure end of the conductor illustrated in FIG. 2.

Referring now to FIG. 5, there is illustrated a dielectric insert 64 for use on the high pressure end 28 of the conductor 24 illustrated in FIG. 2. The insert 64 is preferably constructed of fiberglass and from the same material used to construct inserts 40 and 46 located on the low pressure end of the conductor 24.

The insert 64 is comprised of a first diameter 66 connected to a larger diameter 68 which therefore defines an external shoulder 70. The internal diameter of insert 64 contains a first diameter 72 followed by a larger diameter 74 thereby defining a shoulder 76. The insert 64 is inserted over the high pressure end 28 of the conductor 24 in such a manner that internal diameter 74 slides over the shoulder 32. Insert 64 is positioned until the internal shoulder of 76 mates with shoulder 32 at which point the insert is located in place as illustrated in FIG. 7.

The high pressure end of each conductor is secured by bonding the insert 64 to the conductor by means of epoxy which is heated to 160° F for between three to four hours. This process is repeated for each of the conductors in a similar fashion as described previously for the low pressure end.

Figures 7, 8, 9, 10, 11, 12:
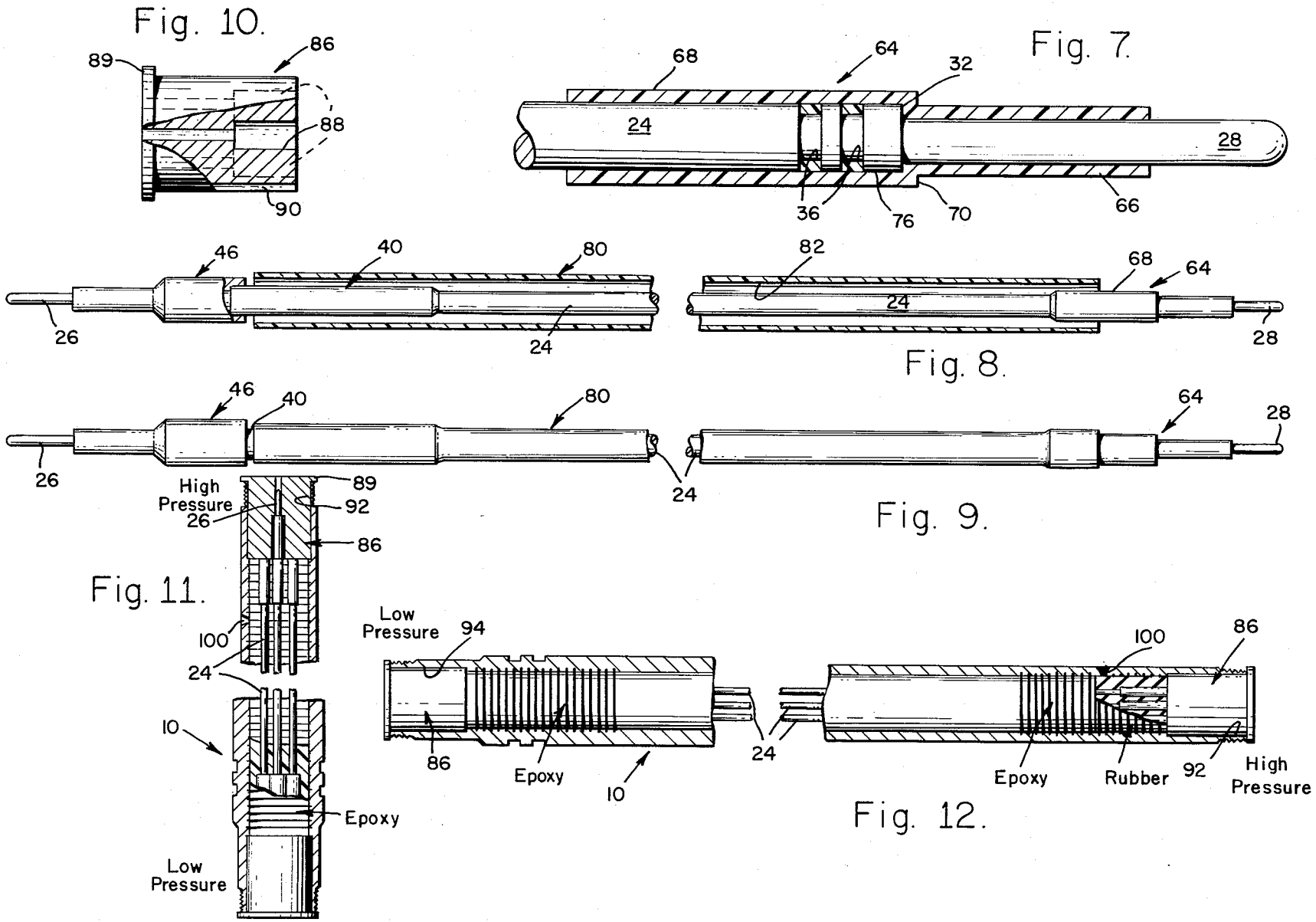
FIG. 7 illustrates the high pressure end of the conductor with the insert illustrated in FIG. 5 located in place.
FIG. 8 illustrates the complete assembld conductor with a polyolefin tubing located loosely on the conductor.
FIG. 9 illustrates a complete conductor with the polyolefin tubing heat-shrunk in place.
FIG. 10 illustrates a moldhead for locating the conductors within the casing during the pouring process.
FIG. 11 illustrates a casing with conductors held in place by means of a moldhead in the high pressure end and a moldhead in the low pressure end prior to pouring the epoxy.
FIG. 12 illustrates the casing in a horizontal position after the epoxy has been poured but before the neoprene rubber has been inserted.

Referring now to FIG. 8, there is shown a complete conductor 24 having inserts 40 and 46 bonded by means of epoxy to the low pressure end of the conductor as at 26 and similarly insert 64 is bonded permanently by means of epoxy to the high pressure end of the conductor as at 28. A tubing of polyolefin 80 having an internal diameter 82 sufficient to pass over the external diameter 68 of insert 64 is placed completely over the conductor 24 so as to abut at the low pressure end against the insert 46 and to cover the diameter 68 of insert 64.

A bonding agent is first placed over the external surfaces to which the polyolefin 80 will be attached and then the complete conductor 24 is placed in an oven and heated to between 180° and 200° F for approximately ten minutes. The heating process will cause the polyolefin to shrink and bond securely to insert 40, conductor 24 and insert 64 wherever contacted.

A review of FIG. 9 will show the effect of the polyolefin 80 after the shrinking and bonding process, thereby showing that all exposed portions of the conductor have either been covered by the fiberglass inserts 46, 40 and 64, or by the polyolefin 80.

All conductors to be inserted within the casing 10 as illustrated in FIG. 1 will be treated in a similar fashion as previously described. The previous steps are necessary to provide a conductor that is completely covered and bonded to a dielectric material. This process ensures that any electrical breakdown must follow a tortuous sinuous path which will have the effect of extinguishing the breakdown before a spark or puncture or other deleterious effect can take place.

Bonding of the dielectric material to the conductor also has the effect of providing increased area between the conductor and the bonding material so as to improve the dielectric bonding of the conductor over one that is not constructed according to the teachings of the present invention.

Referring now to FIG. 10, there is illustrated a moldhead guide 86 having holes 88 for accepting and locating the protruding conductor pins and insert associated with the conductor 24. A shoulder 89 limits the distance the moldhead guide 86 is inserted into the end cavity 92 or 94 of the casing 10. The purpose of the moldhead guide 86 is to locate the individual conductors within the casing 10 during the potting process. A keyway 90 adapted to mate with a key located in both the high pressure cavity and the low pressure cavity of the casing 10 is used for alignment purposes.

Referring now to FIG. 11, there is shown a casing 10 in a vertical position prior to insertion of any of the dielectric bonding materials.

A moldhead guide 86 is located in the counter bore 92 located in the high pressure end and a similar fashion a moldhead guide 86 is located in the counter bore 94 located in the low pressure end of the casing 10.

In the preferred embodiment the casing 10 is placed in a vertical position with the low pressure end in the lowermost position and the high pressure end in the highest position as illustrated. A filler hole 100 located approximately two inches from the moldhead guide 86 located in the high pressure end is located in the side of the casing 10 so as to communicate with the internal diameter. In this position the guides 86 at the high pressure end and the low pressure end will hold individual conductors in position during the pouring process.

The epoxy is poured through the filler hole 100 in steps. For a casing of approximately twenty inches the first pouring is limited to no more than three inches, at which point the pouring is stopped and the complete casing is allowed to set for three to four hours at approximately 160° F to cure the first pouring.

After the casing has cooled, a second pouring is commenced for approximately double the size of the first pouring which in the preferred embodiment was approximately six inches at which point the pouring is stopped and the complete casing is allowed to set for three to four hours at approximately 160° F as before.

The final pouring is continued to within four inches of the moldhead guide 86 and again the complete casing is allowed to set for three to four hours at 160° F.

At this point in time the next step is to remove both the high pressure moldhead 86 and the low pressure moldhead 86 and the resulting cavity is cleaned with trichloroethylene which is basically a dry cleaning solvent which is removed by means of high pressure air. Any epoxy that has slipped through the moldhead guides 86 is physically trimmed and removed.

Referring now to FIG. 12, there is shown the casing 10 in a horizontal position with the moldhead guides 86 again placed in position, preparatory to injecting neoprene rubber through the filler hole 100.

In this position the complete casing assembly is heated to 275° F and the neoprene which is located in a hot press is transferred in a single operation and poured through the filler hole 100 into the remaining cavity.

The complete mandrel is then heated to between 325° and 350° F which causes the neoprene to expand through the filler hole 100. This heating process is continued for 45 minutes to allow the neoprene to vulcanize.

The casing 10 is then removed and cooled and the moldhead guides 86 are removed and the unit physically deburred and cleaned. The filler hole 100 is cleaned and deburred and a suitable pipe pulg is inserted into the filler hole and molded in place. In the preferred embodiment the pipe plug is cut off and buffed smooth thereby leaving a completely sealed unit.

The materials used in the potting process are conventional materials available on the open market and they include Epocast 220 epoxy manufactured by Furane Company; the polyolefin material is obtained from Insulation Supply Company; the polyolefin bonding material such as P-5 bonding agent or P-5 primer is manufactured by Thixon Corporation; the neoprene and neoprene bonding agent is obtained from Hotsplicer Corporation. The preferred epoxy is actually a two-part epoxy comprising a resin epocast 220 and a 927 hardener.

A review of the resulting structure will show that the high pressure end of the casing consists of neoprene rubber that is deformable under a pressure gradient. In this fashion the deformable dielectric material provides a self-healing or failsafe operation in which any pressure leakage or defective seal is immediately closed by the very action of the pressure causing or tending to cause any break in the sealing mechanism.

A review of the individual conductors potted within the internal diameter of the casing will show that the internal diameter of the high pressure insert abutting against the shoulder on the conductor physically locks the insert to the conductor in a combined effort to resist movement caused by the pressure gradient.

A review of the low pressure end will show that the variable outside diameter of the fiberglass insert at the low pressure end when molded in the epoxy which exists for the major length of the conductors except for the last four inches of neoprene rubber, is caused to push against the main body of the epoxy thereby again tending to hold the conductor and the insert which is bonded to the conductor from moving or blowing out under the action of the high pressure gradient.

A review of the internal diameter of the casing will show that the vertical face of the triangle cross-section of the grooves located on the internal diameter of the casing will further increase the area of contact between the internal surface and the epoxy bonding material again holding the conductors in place against the action of the pressure differential.

I claim:

1. An electrical feed-through assembly comprising:

a hollow tubular casing having means on the periphery for restraining and sealing said casing in a high differential pressure environment, a plurality of separate electrical conductors electrically insulated from each other and mechanically supported within the length of said hollow casing, separate rigid dielectric materials bonded to the end portions of each conductor for providing electrical insulation and mechanical rigidity against the differential pressure for each conductor, and a separate flexible tube of dielectric material completely covering each conductor and bonded and sealed to said rigid dielectric materials at each end of each conductor and to each conductor therebetween.

2. An electrical feed-through assembly according to claim 1 in which each flexible tube comprises a tube of polyolefin that is heat shrunk and bonded to its associated conductor and said rigid dielectric materials.

3. An electrical feed-through assembly according to claim 1 in which said conductors are insulated and supported in said casing by a deformable dielectric bonding material holding said conductors within said casing in the area of the high pressure end whereby pressure will deform said material to improve the seal between said conductors and said casing, and a substantially non-deformable dielectric bonding material located adjacent said deformable material and extending within said casing to the area of the low pressure end for fixedly holding said conductors within said casing whereby the conductors will withstand both high voltage and high pressure differentials.

4. An electrical feed-through assembly according to claim 3 in which said deformable dielectric bonding material is neoprene rubber bonded and vulcanized in place and said non-deformable dielectric bonding material is epoxy that is set and cured in place.

5. An electrical feed-through assembly according to claim 3 in which said deformable dielectric bonding material is placed adjacent the high pressure end of said high differential pressure environment.

6. An electrical feed-through assembly according to claim 3 in which said deformable dielectric bonding material extends substantially one-eighth of the total length of the casing measured from the high pressure end and said non-deformable dielectric material extends adjacent said deformable material for the remaining seven-eighths of the total length and measured towards the low pressure end.

7. An electrical feed-through assembly comprising:

a hollow tubular casing having means on the periphery for restraining and sealing said casing between a high and low pressure environment, a plurality of separate electrical conductors electrically insulated and supported within the length of said hollow casing, dielectric materials completely covering and bonded to each conductor, a separate deformable dielectric bonding material adjacent the high pressure end for sealing and insulating said conductors within said casing whereby pressure will deform said material to improve the seal between said conductors and said casing, and a substantially non-deformable dielectric bonding material located adjacent said deformable material and extending within said casing to the area of the low pressure end for fixedly supporting and insulating said conductors in said casing whereby the conductors will withstand both high voltage and high pressure differentials.

8. An electrical feed-through assembly comprising:

a hollow tubular casing having means on the periphery for restraining and sealing said casing in a high differential pressure environment, a plurality of separate electrical conductors electrically insulated and supported within the length of said hollow casing, dielectric materials completely covering and bonded to each conductor, said dielectric materials and conductors having different internal and external diameters to form increased bonding areas to withstand high pressure differentials and a sinuous tortuous path to withstand high voltage differences, a deformable dielectric bonding material holding said conductors within said casing in the area of the higher pressure end whereby pressure will deform said material to improve the seal between said conductors and said casing, and a substantially non-deformable dielectric bonding material located adjacent said deformable material and extending within said casing to the area of the low pressure end for fixedly holding said conductors within said casing whereby the conductors will withstand both high voltage and high pressure differentials.

9. The method of constructing a feed-through assembly having a plurality of conductors located within a casing and capable of withstanding high voltage and high pressure differentials comprising the steps of:

first epoxy a fiberglass dielectric insert to each end of the conductors, then cover portions of each insert with a tube of polyolefin dielectric that is shrunk in place over the conductor and the inserts, locate a filling hole in the side of the casing close to the high pressure end, then locate and hold the individual conductors within the casing, then holding the casing in a vertical position with the high pressure end down charge the casing with a first small amount of epoxy and heat cure, then charge the casing with a second amount of epoxy larger than the first and heat cure, then charge the casing with a third amount of epoxy to a point below the filling hole and heat cure, then place the casing on its side with the filling hole vertical and heat, then insert neoprene heated within the filling hole until the casing is full, then heat the casing again until the neoprene is vulcanized, and then insert a plug into the filling hole and seal.

10. The method of constructing a feed-through assembly according to claim 9 comprising curing the epoxy at a temperature of approximately 160° F for a time of three to four hours.

11. The method of constructing a feed-through assembly according to claim 9 comprising heating the casing to approximately 275° F prior to inserting the neoprene rubber.

12. The method of constructing a feed-through assembly according to claim 9 comprising heating the completed casing with neoprene rubber instead to a temperature of between 325° and 350° F for approximately 45 minutes to vulcanize the neoprene.

13. The method of constructing a feed-through assembly according to claim 9 comprising the step of placing the conductors with the fiberglass inserts and the polyolefin tubes located over the inserts and the conductors in an oven for approximately ten minutes at 180° to 200° F to heat shrink the polyolefin tubes along their complete length to the inserts and the conductors.

* * * * *